United States Patent [19]

Suzuki et al.

[11] 4,147,032

[45] Apr. 3, 1979

[54] SECONDARY AIR SUPPLY CONTROL SYSTEM

[75] Inventors: Michio Suzuki, Hekinan; Ken Shiozawa, Toyota, both of Japan

[73] Assignee: Toyota Jidosha Kogyo Kabushiki Kaisha, Toyota, Japan

[21] Appl. No.: 799,267

[22] Filed: May 23, 1977

[30] Foreign Application Priority Data

Dec. 21, 1976 [JP] Japan ..... 51/170302[U]

[51] Int. Cl.[2] ..... F01N 3/10

[52] U.S. Cl. ..... 60/290

[58] Field of Search ..... 60/290

[56] References Cited

U.S. PATENT DOCUMENTS

| | | | |
|---|---|---|---|
| 3,392,523 | 7/1968 | Hyde | 60/290 |
| 3,888,080 | 6/1975 | Nohira | 60/290 |
| 3,906,723 | 9/1975 | Matumoto | 60/290 |
| 4,050,249 | 9/1977 | Collins | 60/290 |

*Primary Examiner*—Douglas Hart

*Attorney, Agent, or Firm*—Stevens, Davis, Miller & Mosher

[57] ABSTRACT

A secondary air supply control system including: an air cleaner; an air pump connected to the air cleaner; a valve having a first chamber and a second chamber, which are separated by a diaphragm and communicated with each other through a first orifice, and controlling the supply of secondary air from the air pump to an exhaust manifold, in response to deflection of the diaphragm; and a passage connecting the second chamber to an intake manifold in a position downstream of a throttle valve in a carburetor and having a second orifice. In addition, a check valve which allows the flow of the secondary air only in the direction towards the exhaust manifold is provided in a passage interconnecting the valve and the exhaust manifold. In this system, an open cross-sectional area of the first orifice is smaller than that of the second orifice provided in the aforesaid passage.

6 Claims, 1 Drawing Figure

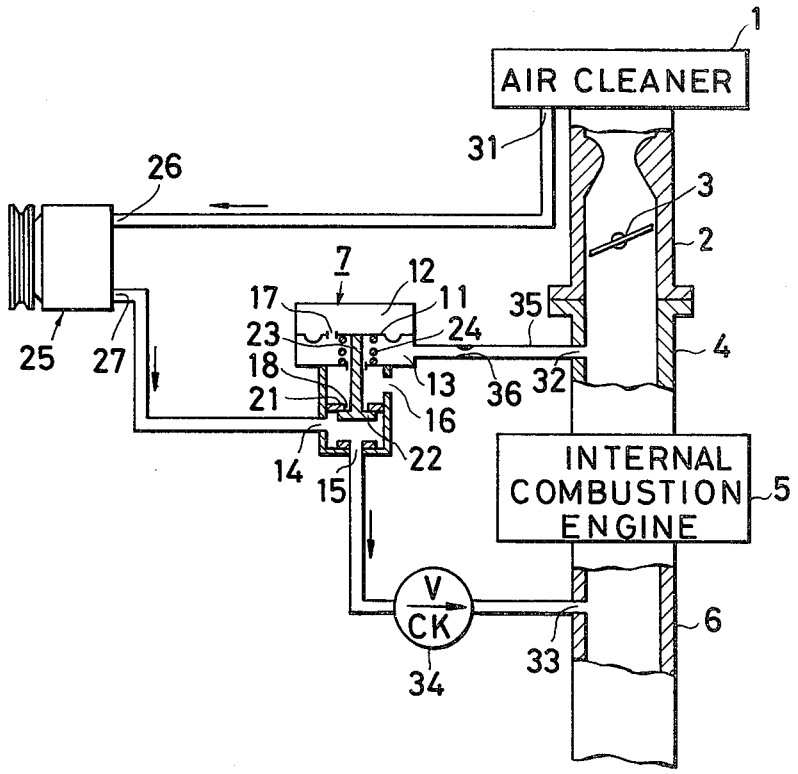
1
AIR CLEANER
31
26
3
2
7
12
17
11
35
23
24
4
25
27
18
13
36
32
21
16
14
22
15
INTERNAL
COMBUSTION
ENGINE
5
V
CK
6
33
34

SECONDARY AIR SUPPLY CONTROL SYSTEM

BACKGROUND OF THE INVENTION

1. Field of the Invention:

This invention relates to a secondary air supply control system, in which unburnt constituents of exhaust gases from an engine are oxidized with secondary air supplied to an exhaust manifold therein.

2. Description of the Prior Art:

It has been a general practice for a secondary air supply system to interrupt the supply of secondary air to an exhaust manifold for preventing after-firing, during a speed change or engine deceleration.

Meanwhile, it is known that there is no danger of after-firing when secondary air is supplied to an exhaust manifold, when the time required for a speed change is relatively short, or a time during which the engine is maintained in a decelerating condition is relatively short. Thus, there arises a demand for supplying secondary air to an exhaust manifold for oxidizing unburnt emissions in the above cases, thereby preventing the emission of harmful gases to the atmosphere.

SUMMARY OF THE INVENTION

It is an object of the present invention to provide a secondary air supply control system which may supply secondary air to an exhaust manifold, during a speed change operation or during an engine deceleration which take place for a limited period of time.

According to the present invention, there is provided a secondary air supply control system, comprising: an air cleaner; an air pump connected to the air cleaner; a valve having a first chamber and a second chamber, which are separated by a diaphragm and communicated with each other through a first orifice, and controlling the supply of secondary air from the air pump to an exhaust manifold, in response to deflection of the diaphragm; a passage connecting the second chamber to an intake manifold in a position downstream of a throttle valve in a carburetor and having a second orifice; and a check valve allowing the flow of the secondary air only in the direction towards the exhaust manifold and provided in a passage connecting the valve to the exhaust manifold. In this system, an open cross-sectional area of the first orifice is smaller than that of the second orifice provided in the aforesaid passage.

BRIEF DESCRIPTION OF THE DRAWINGS

The drawing is a schematic view of a secondary air supply control system according to the present invention.

DESCRIPTION OF THE PREFERRED EMBODIMENTS

Referring to the drawing, shown at 1 is an air cleaner for cleaning the incoming air. At 2 is a carburetor, and at 3 a throttle valve in the carburetor. Interconnected between the carburetor 2 and an internal combustion engine 5 is an intake manifold 4.

Connected to the internal combustion engine 5 downstream thereof is an exhaust manifold 6. shown at 7 is a vacuum responsive valve which includes first and second vacuum chambers 12, 13 which are separated by a diaphragm 11 and communicated with each other through a first orifice 17 provided in the diaphragm 11. The vacuum responsive valve further includes third and fourth chambers which are separated by a partition wall

21, with the third chamber being contiguous to the second chamber. The third chamber has a port 16 open to the atmosphere, and the fourth chamber has ports 14 and 15. The partition wall 21 has a center hole 18. Shown at 22 is a valve body having a stem 23 which is coupled to the diaphragm 11 through the center hole 18 in the partition wall 21. The valve body 22 is positioned within the fourth chamber with respect to the partition wall 21. Thus, the valve body 22 is adapted to contact either the port 15 or the port 18, depending on the deflection of the diaphragm 11. It should be noted in this connection that no clearance is provided around the valve stem 23 which extends through the partition wall between the second and third chambers, while a suitable clearance is provided between the stem 23 and the periphery of the central hole, i.e., the port 18. A coil spring 24 is provided in the second chamber 13 so as to urge the diaphragm 11 towards the first chamber so as to help the valve body 22 maintain the port 18 closed.

Shown at 25 is an air pump which has an intake port 26 and a discharge port 27, and thus the air pump 25 draws air through the intake port 26 and discharges the air through the discharge port 27.

A port 31 is provided in the air cleaner 1 in a position downstream of a filter element not shown. A port 32 is provided in the wall of an intake manifold 4 downstream of the throttle valve 3. Secondary air supply port 33 is provided in the wall of the exhaust manifold 6.

The intake port 26 in the air pump 25 is connected to the port 31 in the air cleaner 1, while the discharge port 27 is connected to the port 14 in the vacuum responsive valve 7. The port 16 in the vacuum responsive valve 7 is open to the atmosphere, as has been described earlier, while the port 15 is connected by way of a check valve 34 to the secondary air supply port 33 in the exhaust manifold 6. The vacuum chamber or the second chamber 13 is connected by way of a passage 35 to the port 32 in the intake manifold 4. An orifice 36 is provided in the passage 35, as shown. The open cross-sectional area of the orifice 36 is larger than that of the orifice 17 in the vacuum responsive valve 7. Meanwhile, the check valve 34 allows the flow of secondary air only in the direction from the port 15 in the vacuum responsive valve 7 to the supply port 33 in the exhaust manifold 6.

In operation, when a variation in load being applied to the engine is small relative to the time, i.e., when the opening of the throttle valve 3 is small, then a variation in intake manifold vacuum relative to the time is small. Accordingly, vacuum levels in the vacuum chambers 12 and 13 in the vacuum responsive valve 7, which is connected by way of the passage 35 to the port 32, are substantially the same. Thus, the diaphragm 11 is biased upwardly under the action of the spring 24, so that the valve body 22 is detached from the port 15 to contact the port 18 to close same. Thus, pressurized air is supplied from the discharge port 27 in the air pump 25 by way of ports 14, 15 in the vacuum responsive valve 7 through the supply port 33 into the exhaust manifold 6.

When the time during which the internal combustion engine 5 is maintained in decelerating condition is relative short, or when the time required for a speed changing operation is relatively short, the time during which the intake manifold vacuum is maintained at a high level is short. The time required for the intake manifold vacuum to be introduced from the port 32 to the vacuum chamber 13 in the vacuum responsive valve 7 may be delayed a given period by means of the orifice 36.

As a result, the throttle valve 3 is opened again, before an increased intake manifold vacuum is introduced to the vacuum chamber 13 in the vacuum responsive valve 7, so that the valve body 22 in the vacuum responsive valve 7 remains in contact with the port 18. In this case, as well, secondary air is supplied from the discharge port 27 in the air pump 25 by way of ports 14, 15 in the vacuum responsive valve 7 and check valve 34, then through the supply port 33 into the exhaust manifold 6.

When the internal combustion engine 5 is maintained in a decelerating condition for a relatively long time, or when the time required for a speed changing operation is relatively long, i.e., when the time during which the throttle valve 3 is maintained in its idle position is relatively long, the time during which the intake manifold vacuum is maintained at a high level will be long. The increased intake manifold vacuum is introduced from the port 32 through the orifice 36 in the passage 35 into the vacuum chamber 13 in the vacuum responsive valve 7. Since orifice 17 is provided between the vacuum chamber 12 and the vacuum chamber 13, the increased vacuum takes a certain time to be introduced from the vacuum chamber 13 to the vacuum chamber 12. Accordingly, the diaphragm 11 is deflected against the action of the spring 24 due to a vacuum difference between the chambers 12 and 13, so that the valve body 22 moves from the port 18 to contact the port 15 to close same. Thus, secondary air is supplied from the discharge port 27 in the air pump 25 by way of ports 14, 18, 16 in the vacuum responsive valve 7 to the atmosphere, rather than through the supply port 33 into the exhaust manifold 6. The reason why an open cross-sectional area of the orifice 17 in the vacuum responsive valve 7 is smaller than that of the orifice 36 in the passage 35 is to lessen the build-up rate of vacuum in the vacuum chamber 12, as compared with the rate of vacuum to be built up in the vacuum chamber 13, thereby providing a desired vacuum difference between the vacuum chambers 12 and 13.

Meanwhile, in the embodiment shown, pressurized air is supplied from the air pump to the exhaust manifold. In addition, the principle incorporated in the present invention may be applied to the secondary air supply system utilizing the pulsating vacuum prevailing within the exhaust manifold for introducing secondary air to the exhaust manifold.

As is apparent from the foregoing description of the secondary air supply control system according to the present invention, when a speed change operation or engine deceleration take a relatively short time, secondary air will be supplied to the exhaust manifold. As a result, harmful constituents of exhaust gases from an engine may be oxidized into an innocuous form, when discharged into the atmosphere.

While the present invention has been described herein with reference to a certain exemplary embodiment thereof, it should be understood that various changes, modifications, and alterations may be effected without departing from the spirit and the scope of the present invention, as defined in the appended claims.

What is claimed is:

1. A secondary air supply control system for use in an internal combustion engine, comprising:

an intake manifold;

an exhaust manifold;

an air pumping means;

a valve having a first chamber and a second chamber, which are separated by a diaphragm and communicated with each other through a first orifice provided in said diaphragm, means interconnecting said valve to the air pumping means and the exhaust manifold, said valve controlling the supply of secondary air from the air pumping means to the exhaust manifold in response to the deflection of said diaphragm; and a passage directly connecting said second chamber to said intake manifold in a position downstream of a throttle valve in a carburetor, said passage having a second restricted orifice therein.

2. The secondary air supply control system of claim 1, wherein the open cross-sectional area of said first orifice is smaller than that of said second orifice.

3. The secondary air supply control system of claim 1, including a check valve in the passage interconnecting said valve and said exhaust manifold, said check valve allowing the flow of secondary air only in the direction towards said exhaust manifold.

4. The secondary air supply control system of claim 1, in which said air pumping means is an air pump.

5. A secondary air supply system for use in an internal combustion engine, comprising:

an intake system;

an exhaust system;

an air pumping means;

a valve comprising a first chamber and a second chamber separated by a diaphragm and in fluid communication with each other through a first orifice in said diaphragm, said valve further comprising a valve body secured to and movable by said diaphragm;

means defining a secondary air flow path through which secondary air is fed from said air pumping means to said exhaust system;

said valve body being movable by said diaphragm to close said flow path; and a passage connecting said second chamber to said intake system in a region thereof downstream of a throttle valve in a carburetor, said passage having a second restricted orifice therein.

6. A secondary air supply system for use in an internal combustion engine, comprising:

an intake system;

an exhaust system;

an air pumping means;

a valve comprising a first chamber and a second chamber separated by a diaphragm and in fluid communication with each other through a first orifice in said diaphragm, said valve further comprising a third chamber fluidly interconnecting said air pumping means with said exhaust system, said third chamber having a secondary air opening therein through which said third chamber fluidly communicates with said exhaust system, said valve further comprising a valve body in said third chamber, said valve body being secured to and movable by said diaphragm to close said secondary air opening to cut off the supply of secondary air to said exhaust system from said air pumping means; and a passage connecting said second chamber to said intake system in a region thereof downstream of a throttle valve in a carburetor, said passage having a second restricted orifice therein.

* * * * *